US009199506B2

(12) United States Patent
Lim

(10) Patent No.: US 9,199,506 B2
(45) Date of Patent: Dec. 1, 2015

(54) HOLE-PUNCHED BINDER CLIP

(71) Applicant: Stephen Sophorn Lim, Desert Hot Springs, CA (US)

(72) Inventor: Stephen Sophorn Lim, Desert Hot Springs, CA (US)

( * ) Notice: Subject to any disclaimer, the term of this patent is extended or adjusted under 35 U.S.C. 154(b) by 0 days.

(21) Appl. No.: 13/987,054

(22) Filed: Jun. 27, 2013

(65) Prior Publication Data

US 2015/0000084 A1 Jan. 1, 2015

(51) Int. Cl.
*B42F 1/00* (2006.01)

(52) U.S. Cl.
CPC ..... *B42F 1/006* (2013.01); *Y10T 24/203* (2015.01); *Y10T 24/44256* (2015.01)

(58) Field of Classification Search
CPC .. B42F 1/006; Y10T 24/44256; Y10T 24/203
USPC ..... 24/67.3, 67.5, 67.7, 67 R
See application file for complete search history.

(56) References Cited

U.S. PATENT DOCUMENTS 4,532,680 A * 8/1985 Hashimoto ..... 24/67 R
4,696,081 A * 9/1987 Yen ..... 24/558
4,735,438 A * 4/1988 Demarest, Jr. ..... 281/42
4,761,862 A * 8/1988 Hiromori ..... 24/67.9
5,301,393 A * 4/1994 Brown ..... 24/67.7
5,335,399 A * 8/1994 Chou ..... 24/67.7
5,533,236 A * 7/1996 Tseng ..... 24/67.5
6,327,749 B1 * 12/2001 Antinone ..... 24/67 R
6,374,463 B1 * 4/2002 Kaufman ..... 24/67.5
7,120,969 B2 * 10/2006 Carls ..... 24/67.3
7,730,593 B1 * 6/2010 Juilly ..... 24/67.5
2003/0115722 A1 * 6/2003 Shogbamimu et al. ..... 24/67 R
2004/0040122 A1 * 3/2004 Huang ..... 24/67.5

* cited by examiner

*Primary Examiner* — Robert J Sandy
*Assistant Examiner* — Louis Mercado

(57) ABSTRACT

An improved binder clip embodies a hole-punched feature annex to the clip body is derived to provide a set of wings that meet at the center normal to the pivotal plane. Incisions to each side of the clip bodies, counter folds to take shape, provides for nominal holes to be cut into the center of each wings. A supplementary feature to the grip handle is reshaped to develop the center contour. The grip handles suspends to the hinges of the clip body, at position against the two folded edges of the clip contains center contour feature to propose clearance for any protrusions from the hole-punched annex wings of the clip to pass through. The innovative clip features are developed to assist in storing, organizing, and transporting of documents with stationary devices and posting applications e.g. inside a three-ring binder folder, any ring document holder applications, or hanging temporary documents on a bulletin board, hanging documents on a wall, etc.

3 Claims, 4 Drawing Sheets

HOLE-PUNCHED BINDER CLIP

CROSS-REFERENCE TO RELATED APPLICATION

App. No. 61/853,461
File Date: Apr. 6, 2013

FEDERALLY SPONSORED RESEARCH

Not Applicable

SEQUENCE LISTING OR PROGRAM

Not Applicable

BACKGROUND OF THE INVENTION

1. Field of Invention

This invention relates to the development of additional features of an annex wings and center contour grip handle to the existing binder clip for gripping loose sheets of paper especially in office environments where storing, organizing, and transporting of documents are implemented today.

2. Description of Prior Invention

A binder clip said to hold loose sheets of paper together is implemented in an educational institutions, office edifices (private and government) and business offices of all size environment. The invention is known since 1915, when Louis E. Baltzley obtained his Paper-Binding Clip patent with U.S. Pat. No. 1,139,627. The approach derives a thin band-metal, which folds into a triangular shape allows for the ends to join, which is rolled up into hinge-like convergences. A wire shape for hand gripping suspends at the hinges allow for the clip to jaw open or closes when pinched or released at the grip handle cantilever end.

Many binder clips were developed thereafter 1915 with many great features like that of U.S. Pat. No. 7,992,260 to Juilly, which the clip function added a label holder at the pivotal plane or opposite to the grip jaw end. Sato of U.S. Pat. No. 5,950,283 developed a clip to contain an incision at the pivotal plane of the clip to allow the corner of the papers to protrude when gripped. Another, U.S. Pat. No. 5,533,236 to Tseng developed the paper holder and grip handle so that tangling does not take place when storing.

A provisional patent application No. 61/853,461 filed on Apr. 6, 2013 develops an additional feature to the existing binder clip, Hole-Punched Binder Clip (HPB Clip). With the same functions of temporarily holding loose papers together with a clip, the HPB Clip is developed with an annexed set of wings to the clip body for use along with other stationary devices. A reshape of the grip handle to make a center contour feature thereby allows for any protrusions from the annex wings feature to pass through, while the grip handle swings or stationed at any allowed stop position. These innovative features are also developed to assist in storing, organizing, and transporting of documents with stationary devices and applications e.g. inside a three-ring binder folder, any ring document holder applications, or hanging temporary documents on a bulletin board, hanging documents on a wall, etc.

Objects and Advantages

Accordingly, with the provisional patent application No. 61/853,461 on Apr. 6, 2013 for the HPB Clip, some objects and advantages are:

At the clip body, a set of wings met, is derived with incisions to the body clip counter folds to have a nominal hole cut into the center to pursue an additional application feature i.e. to be implemented with a three-ring binder folder, any ring binder folder, hanging on documents on a bulletin board, wall, etc.

Coincided with the annex wings, a convenience feature to the grip handle is reshaped to contain a center contour to allow for clearances for any protrusions to pass through from the annex wings, should the grip handle is positioned against the clip body or two fold edges.

SUMMARY OF THE INVENTION

An improved binder clip embodies a hole-punched feature annex to the clip body is derived to provide a set of wings that meet at the center normal to the pivotal plane. Incisions to each side of the clip bodies, counter folds to take form, provides for nominal holes to be cut into the center of each wings. The clip body of band metal material is folded twice to pursue a triangular form, with a pivotal center plane and two isosceles planes with the ends rolled up into hinges meet.

A supplementary feature to the grip handle is reshaped to develop the center contour. The grip handles suspends to the hinges of the clip body, at position against the two folded edges of the clip contains center contour feature to propose a clearance for any protrusions from the hole-punched annex wings of the clip to pass through. Suspending on the triangular folded sheet metal edges, the grip handle counter swing is in contact with the folded edges at the pivotal plane, allows for clip body end to pivot, translating an opening at the end hinges to jaw open.

The innovative clip features are developed to assist in storing, organizing, and transporting of documents with stationary devices and posting applications e.g. inside a three-ring binder folder, any ring document holder applications, or hanging temporary documents on a bulletin board, hanging documents on a wall, etc.

BRIEF DESCRIPTION OF THE DRAWINGS

In the drawings, figures in some views are composed with the same reference numbers in different assembly views for the Hole-Punched Binder Clip.

DRAWINGS - Reference Numerals

| | | | |
|---|---|---|---|
| 10 | Annex Wings | 12 | Round Notches |
| 14 | Pivotal Curve | 16 | Hinges |
| 18 | Reinforced Fold | 20 | Two Fold Edges |
| 22 | Clip Body | 24 | Counter Fold Edges |
| 26 | Incision Cuts | 28 | Wire Insert Ends |
| 30 | Hole-Punched Cut | 32 | Center Contour |
| 34 | Grip Handle(s) | 36 | Fixed End |
| 38 | Mid Portion | 40 | Cantilever End |
| 42 | Grip Jaw | | |

DETAILED DESCRIPTION OF THE INVENTION

FIG. 1—Embodiment

Figure 1:
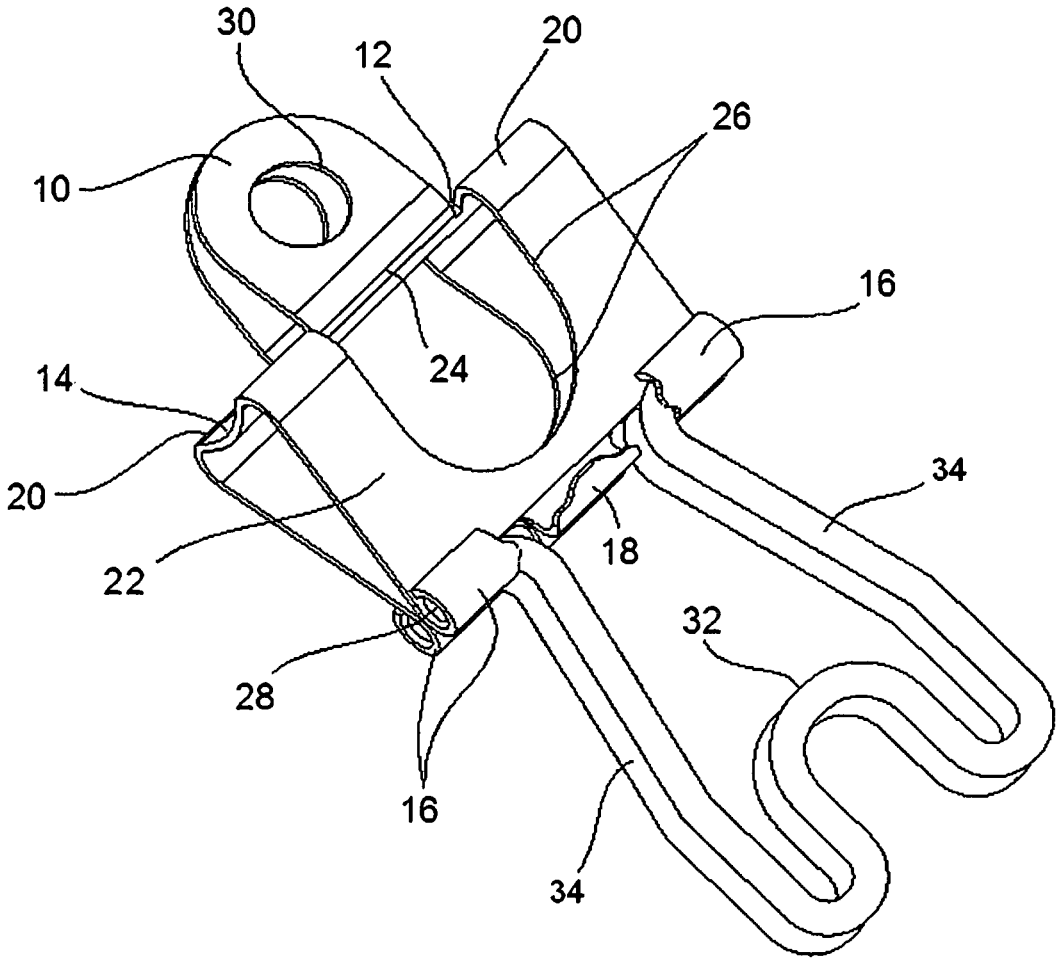
FIG. 1 shows a trajectory view of the hole-punched annex wings and grip handles positioned away from the clip body.

A preferred embodiment of the invention in FIG. 1 (three-dimensional view) derives a thin flexible metal fold twice into a triangular formation with the two clip body (22) of lengths larger than the pivotal curve (14), with the ends rolled up to take shape of hinges (16) would meet; and that the reinforced fold (18) at the center edges would strengthen the grip jaw. The grip handle (34) with specific center contour (32) shape allows clearance for protrusions to pass through from the annex wings (10) when at rest position on either or both sides of the clip body (22). The end of the grip handle (34) is bent to contain the wire insert ends (28), which then suspends within the hinges (16) of the clip body (22). On both sides of the clip body (22), incision cuts (26) partake in a form of a "D" shape with the flat edge of the "D" runs parallel with the pivotal curve (14). Round notches (12) are generated at the end of the incisions to avoid tearing when counter fold edges (24) are constructed from each of the two fold edges (20) to generate two annex wings (10) transverse to the pivotal curve (14) joins together. A nominal hole-punched cut (30) is established at the center of the annex wings (10) on both sides.

Figure 2:
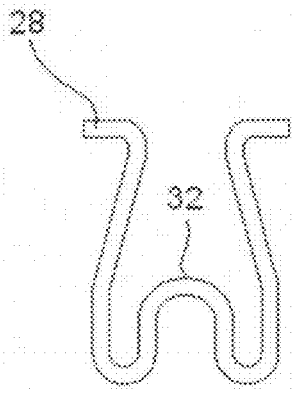
FIGS. 2 to 2A shows the front view and side view of the grip handle.
Figure 2A:
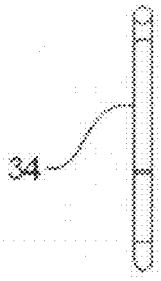
Figure 3:
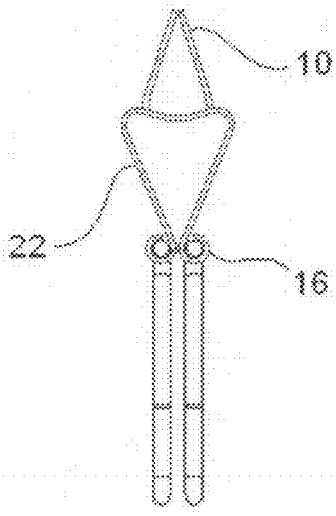
FIG. 3 shows the side view of an assembled clip body with grip handle suspending vertical or away from the clip body.

FIGS. 2-2A—Embodiment

A preferred embodiment of the grip handle (34) wire in FIG. 2 (front view) and FIG. 2A (side view) is specially shape for specific shaping of the center contour (32) with other counter curves to each end with bent tips as the wire insert ends (28).

FIG. 3—Embodiment

An assembled embodiment in Figure (side view) shows the annex wings (10) of both sides to join center normal to the pivotal curve (14) at the top of the clip body (22). Profiling along the two larger bodies of the clip body (22), wire insert ends (28) is suspended within the hinges (16), as the grip handles (34) situate to one of the normal rest positions.

FIG. 4—Embodiment

Figure 4:
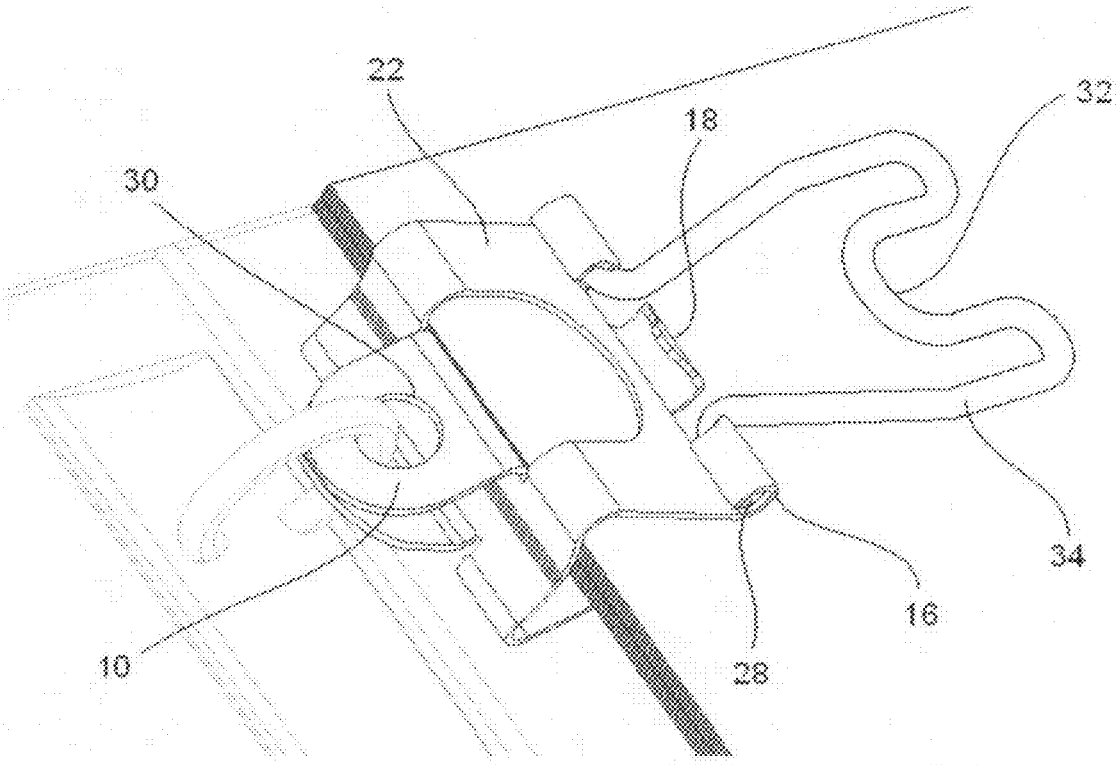
FIG. 4 shows partial view of an assembled clip gripping sheets of paper and suspending onto one of the stationary devices, a three-ring binder folder.

An assembled embodiment in FIG. 4 (three-dimensional view) is in application, thereby is comprised of a grip handle (34) with a specific center contour (32) shape, rest positioned lateral with the gripped sheets of paper is suspended with the wire insert ends (28) inside the hinges (16) of the clip body (22). The papers are supported with the reinforce fold (18) center to the hinges (16), which then HPB Clip is suspended onto a three-ring binder folder (partial cut view) through the hole-punched cut (30) at the two merged annex wings (10).

Figure 5:
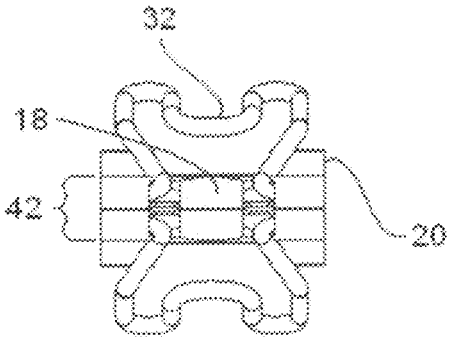
FIGS. 5 to 5A shows the bottom view and top view of the assembled clip to profile the annex wings feature with grip handles at gripping position.
Figure 5A:
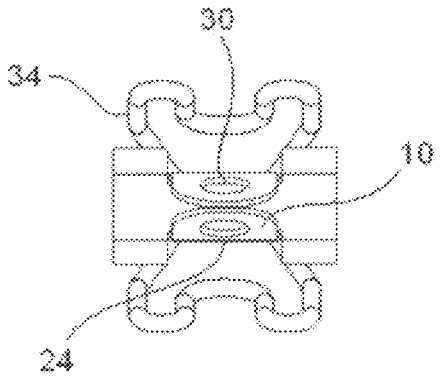

FIGS. 5-5A—Embodiment

An assembled embodiment in FIG. 5 (bottom view) shows the hinges on both sides of the clip body (22) to come together, along with a visible view of the reinforced fold (18) for support when opening and closing of grip jaw (42). Where in FIG. 5A (top view) shows the side view of each of the hole-punched cut (30) annex wings (10), with the counter fold edges (24), when derived from the two fold edges (20).

FIG. 6—Embodiment

Figure 6:
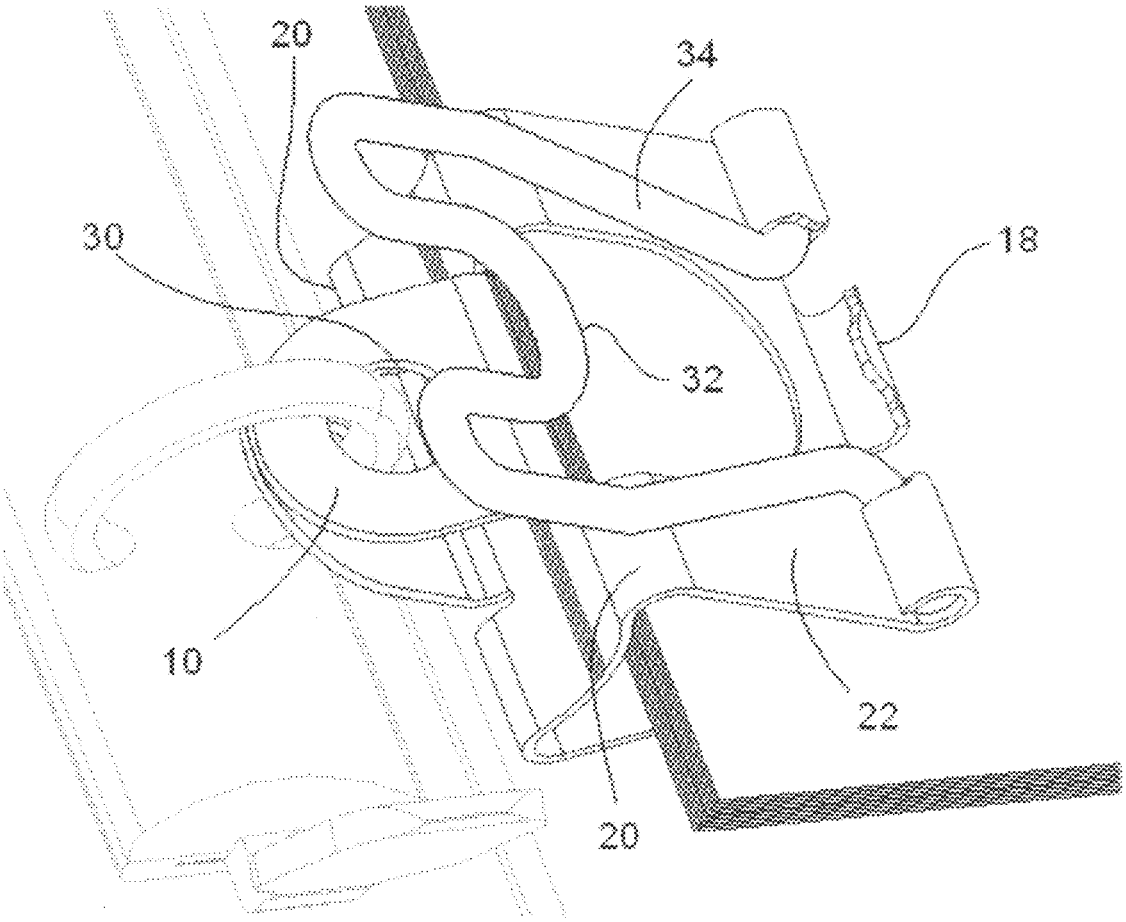
FIG. 6 shows a partial view of an assembled clip gripping sheets of paper with a grip handle at the rest positions and an implementation onto a three-ring binder folder.

An assembled embodiment in FIG. 6 (three dimensional view) shows the grip handle (34) resting against the two fold edges (20), developed to allow any protrusions to pass through the annex wings (10). Depending on the size of the ring of the three-ring binder folder, the center contour (32) of the grip handle (34) allows for any protrusions to past through. The clip body (22) with the hole-punched cut (30) annex wings (10) is in use to suspend onto a three-ring binder folder (partial cut view).

FIG. 7—Embodiment

Figure 7:
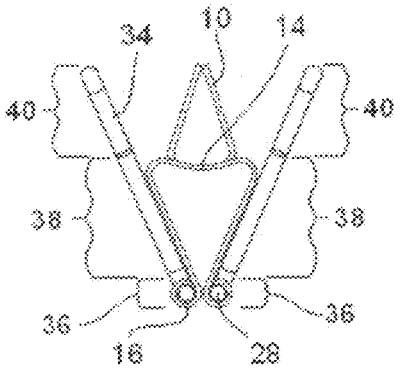
FIG. 7 shows the side view of the assembled clip body and grip handle resting on the clip body.

An assembled embodiment in FIG. 7 (side view) illustrates the annex wings (10) to be joined at the top. The wire insert ends (28) suspend inside the hinges (16) is positioned against the two fold edges (20) as one on the normal position of the grip handle (34). The mechanics of the grip handle (34) on each sides is divided into three partitions, whereas the fixed end (36) comprised of the wire insert ends (28) to suspend within the hinges (16), the mid portion (38) rest on the two fold edges (20), and the cantilever end (40) is the remainder portion of the embodied grip handle (34), free of contact from the clip body (22) at this rest position.

FIG. 7A—Embodiment

Figure 7A:
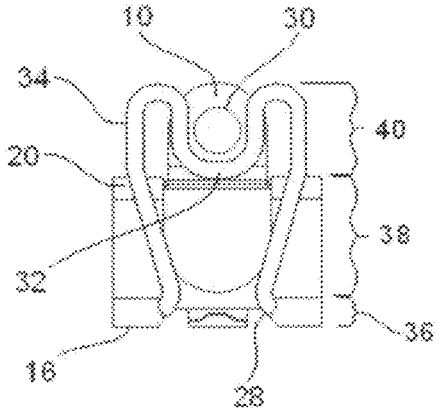
FIG. 7A shows a front view of the annex wings and center contour development of the grip handle so that any protrusions can pass through when implementing the annex wings feature.

An assembled embodiment in FIG. 7A (front view) illustrates the annex wings (10) with the hole-punched cut (30) visible at the center contour (32), developed to allow any protrusions to pass through when the annex wings (10) of the clip is implemented with other stationary devices. Joined at the rolled end hinges (16), the grip handle (34) rest on the two fold edges (20).

FIG. 8—Embodiment

Figure 8:
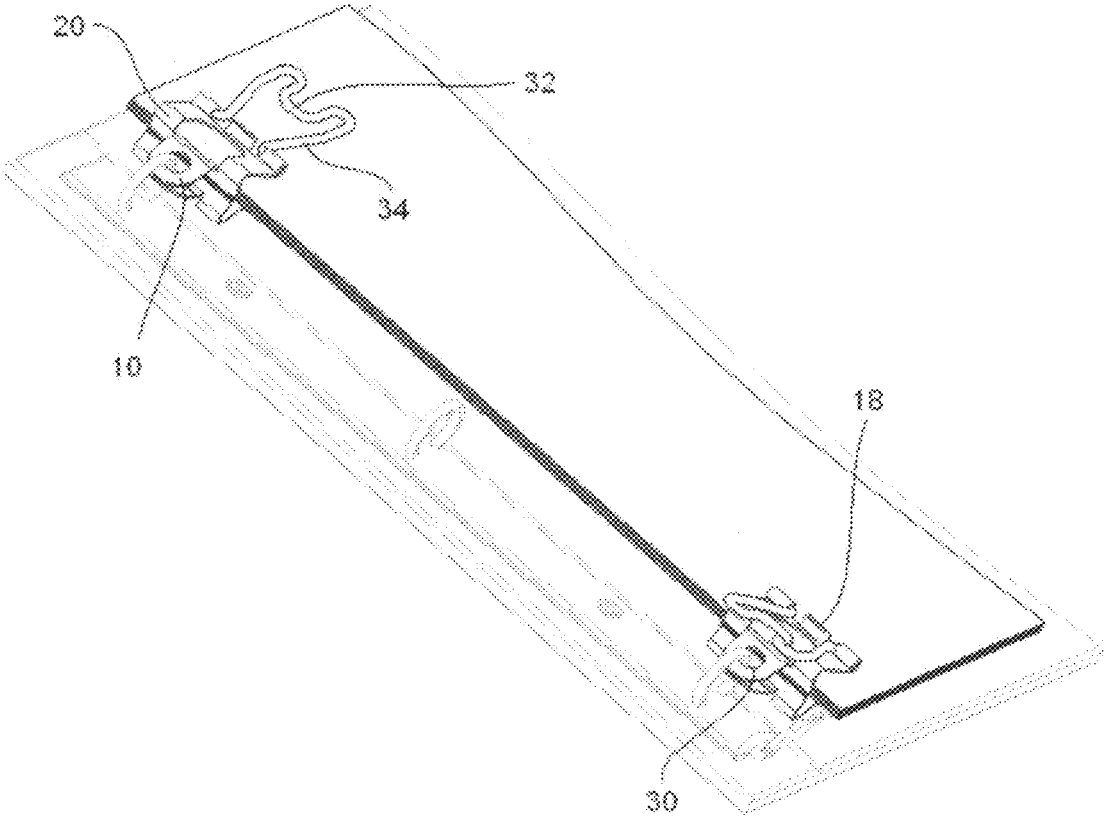
FIG. 8 shows a full view of the HPB Clip in implementation with a three-ring binder folder.

An assembled embodiment in FIG. 8 (three dimensional view) completes the embodied developed clip with implementation demonstration, thereby grips sheets of paper with an application device by method of the hole-punched cut (30) annex wings (10) suspends onto the rings of a three-rings binder folder. Organized documents are gripped along the grip jaw (42) composition of the reinforce fold (18) and hinges (16); with the wire grip handle (34) resting position lateral to the sheets of paper, and with the second clips with the grip handle (34) rest position at the two fold edges (20). The illustration of the center contour (32) feature in the second clip at resting position against the two fold edges (20) allows clearance for any protrusions from the annex wings (10) to pass through.

OPERATIONS

FIGS. 4, 6, 7-7A, 8

An assembly of the clip body (22) with the hole-punched cut (30) at the annex wings (10) is said to contain two grip handles (34) with the wire insert ends (28) suspended at the hinges (16) comprises of two stationary rest positions. As the first position allows for the grip handle (34) to rest along each side of the clip body (22) derives an open and close function for the clip to compose loose sheets of paper to be inserted, at when the handle is released engages in gripping of the papers. The clip is said to operate by method of mechanical force transfer translated from finger pinching interaction to the set of grip handles (34), there operates the opening and closing of the grip jaw (42). In FIGS. 4, 6, 7 and 7A are operations already take function as the gripping of the sheets of paper is applied and suspended onto the ring of a three-ring binder folder.

In details, the mechanics to operate the clip is observed by method of a lever, spring forces at the pivotal curve (14) and/or of the two sides clip body (22) planes. Implementing the grip handle (34) on each side as a lever, there consists of three critical points for the mechanics to function, the fixed end (36), mid portion (38), and cantilever end (40) as illustrated in FIGS. 7 and 7A. The fixed end (36) of the grip handle (34) on both side to the clip body (22) are suspended at the hinges (16), where as the mid portion (38) is in contact with the folded edges or the pivotal curve (14) plane of the clip body (22). The cantilever end (40) allows for the mechanical force to translate from the fingers to provide an opening or closing of the hinges (16) ends or grip jaw (42) when pinched with a set of fingers at the grip handle (34) cantilever end (40) on each sides together.

Observing the causes of the mechanic force within the clip in FIG. 4, 6, 8, there contains two possible mechanical forces, depending on the development of the clip. Continuing from the translation of the finger forces, the first mechanical force can be observed at the pivotal curve (14) plane, which can act as spring-leaf like forces. When the grip handle (34) cantilever end (40) takes operation of pinching both handles, the grip jaw (42) would open; vice versa, the grip jaw (42) closes when released. The second mechanical force can be observed at the clip body (22) planes, on both sides of the clips, the body planes can act as a spring-leaf, which in the same fashion provides operation for opening and closing of the jaw of the clip when grip handles are activated. Another cause is the combinations of two mechanical forces from the pivotal center planes and clip body planes for function for the clip to grip sheets of paper.

An implementation of the improved clip in association with one of the stationary devices is illustrated in FIG. 8, where the annex wings (10) of the clips are suspended onto a three-ring binder folders with options for the clip to be placed lateral to the sheets of papers or counter to rest against the two fold edges (20). There are many useful applications to be implemented with the improve clip with the hole-punched cut (30) annex wings (10) i.e. posting on bulletin boards, wall, etc.

The invention claimed is:

1. A binder clip for an office environment is formed from a band-like metal into a triangular shape clip body, consisting of:

a center pivotal curved portion and two clip body portions each with hinges; suspending within the hinges contain two sets of wire grip handles in parallel with the clip body portions and in contact with folded ends of the center pivotal curved portion, ends of the wire grip handles cantilevers outward from the folded ends;

a D-shaped annex wing formed from each clip body portion by an incision thereof, each D-shaped annex wing having a flat edge counter folded and parallel to the respective folded ends of the center pivotal curved portion, each of the D-shaped annex wing being parallel to both sides of the clip body and extending normal to the center pivotal curved portion of the clip body, and each D-shaped annex wing having a punched hole at a center thereof; and wherein pinching on the cantilevered ends of the wire grip handles function to open the clip, and release of the pinching of the cantilevered ends function to close the clip.

2. The binder clip according to claim 1, wherein each wire grip handle comprise an inward center contour portion having a diameter being larger than a diameter of the punched hole of the respective D-shaped annex wing.

3. The binder clip according to claim 1, wherein the binder clip is for assisting in storing, organizing, and transporting of documents with stationary devices and/or posting applications for inside a three-ring binder folder, any ring document holder applications, hanging temporary documents on a bulletin board, or hanging documents on a wall.

* * * * *